US009415955B2

(12) United States Patent
Matsumoto et al.

(10) Patent No.: US 9,415,955 B2
(45) Date of Patent: Aug. 16, 2016

(54) RECORDING APPARATUS

(71) Applicant: SEIKO EPSON CORPORATION, Tokyo (JP)

(72) Inventors: Akira Matsumoto, Nagano (JP); Seijun Horie, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,275

(22) Filed: Mar. 24, 2014

(65) Prior Publication Data

US 2014/0292981 A1 Oct. 2, 2014

(30) Foreign Application Priority Data

Mar. 26, 2013 (JP) ..... 2013-063555

(51) Int. Cl.

| | |
|---|---|
| ***B65H 1/02*** | (2006.01) |
| ***B65H 16/02*** | (2006.01) |
| ***B41J 11/00*** | (2006.01) |
| ***B41J 15/04*** | (2006.01) |
| ***B41J 13/10*** | (2006.01) |

(52) U.S. Cl.

CPC ..... *B65H 1/027* (2013.01); *B41J 11/001* (2013.01); *B41J 13/10* (2013.01); *B41J 15/042* (2013.01); *B41J 15/046* (2013.01); *B65H 16/02* (2013.01); *B65H 2405/42* (2013.01)

(58) Field of Classification Search

CPC .. B65H 1/027; B65H 1/266; B65H 2402/442; B65H 2402/52; B65H 2402/611; B65H 2402/691; B65H 2405/31; B65H 2405/32; B65H 2405/34; B65H 2801/36; B65H 2405/42; B65H 2405/43; B65H 16/02; B65H 2405/113; B65H 2405/1136

USPC ..... 271/162, 164

See application file for complete search history.

(56) References Cited

U.S. PATENT DOCUMENTS

| | | | | |
|---|---|---|---|---|
| 3,306,491 | A * | 2/1967 | Eisner et al. | 221/41 |
| 6,695,307 | B2 * | 2/2004 | Kanagawa | 271/207 |
| 2002/0000144 | A1 | 1/2002 | Shinga | |

FOREIGN PATENT DOCUMENTS

| | | | | |
|---|---|---|---|---|
| EP | 1209633 | A2 | 5/2002 | |
| JP | 02-276733 | A | 11/1990 | |
| JP | 02276733 | A * | 11/1990 | B65H 3/00 |
| JP | 2003-012205 | A | 1/2003 | |
| JP | 2004-102043 | A | 4/2004 | |

OTHER PUBLICATIONS

The Extended European Search Report for the corresponding European Application No. 14161707.6 dated Sep. 28, 2015.

* cited by examiner

*Primary Examiner* — Michael McCullough

(74) *Attorney, Agent, or Firm* — Global IP Counselors, LLP

(57) ABSTRACT

A recording apparatus includes a housing with a recording unit, and a medium support part. The housing has a first medium path through which the recording medium is configured to pass. The medium support part is slidable with respect to the housing in a sliding direction. The medium support part has a second medium path through which the recording medium is configured to pass. The first and second medium paths have openings that are at least partially disposed on a sliding plane defined between the housing and the medium support part. A wall of the first medium path on one side in the sliding direction and a wall of the second medium path on the other side in the sliding direction are arranged not to contact with respect to each other while the medium support part slides towards the one side in the sliding direction.

7 Claims, 7 Drawing Sheets

RECORDING APPARATUS

CROSS-REFERENCE TO RELATED APPLICATIONS

This application claims priority to Japanese Patent Application No. 2013-063555 filed on Mar. 26, 2013. The entire disclosure of Japanese Patent Application No. 2013-063555 is hereby incorporated herein by reference.

BACKGROUND

1. Technical Field

The present invention generally relates to a recording apparatus.

2. Related Art

In some large-scale inkjet printers and other recording apparatuses, a paper feed unit (medium support part) for mounting a roll of paper (recording medium) is provided such that the paper feed unit can be pulled out from a housing. In such recording apparatuses, medium paths through which the recording medium passes are provided to the paper feed unit and to the housing. In the pulling out of the paper feed unit, it is desirable to prevent cutting, breaking, or the like of the recording medium being passed through the medium paths.

In an inkjet-type image formation apparatus, a roll of paper is fed out at an apparatus back surface from a paper feed unit, and the roll of paper is introduced to an apparatus body at a guide plate that comes down from the back surface side of the apparatus body (see Japanese Unexamined Patent Application Publication No. 2003-12205, for example). The orientation of the guide plate takes an incline less than 45° from the horizontal direction, i.e., an incline closer to the horizontal direction than the vertical direction. The position at which the roll of paper is fed out from the paper feed unit is lower than a sliding plane between the apparatus body and the paper feed unit.

SUMMARY

With the above-described image formation apparatus, the paper path protrudes out on the apparatus back surface side, therefore resulting in a commensurate increase in apparatus size.

This problem is not limited to inkjet-type image formation apparatuses, and is similarly experienced by a variety of recording apparatuses.

In view of this, one aspect is to provide a recording apparatus with which cutting and the like of a recording medium during sliding of a medium support part can be prevented, and with which the medium support part can be reduced in size in a sliding direction.

In accordance with one aspect of the present disclosure, a recording apparatus is provided that includes a housing with a recording unit, and a medium support part. The recording unit is configured to record onto a recording medium. The housing has a first medium path through which the recording medium is configured to pass. The medium support part is slidable with respect to the housing. The medium support part has a second medium path through which the recording medium is configured to pass. The second medium path is configured to connect with the first medium path. The first and second medium paths have openings that are at least partially disposed on a sliding plane defined between the housing and the medium support part. A side, out of the sliding direction of the medium support part, where the linking of the second medium path is released from the first medium path serves as one side in the sliding direction. A wall (hereinafter a "first wall on one side") of the first medium path on the one side in the sliding direction and a wall (hereinafter a "second wall on the other side") of the second medium path on the other side in the sliding direction do not interfere with respect to each other during sliding of the medium support part.

That is to say, the medium paths do not protrude out to the apparatus back surface side. This is because the openings of the two medium paths are at least partially disposed on the sliding plane defined between the housing and the medium support part. Also, cutting or the like of the recording medium by the first wall on one side and the second wall on the other side is prevented during sliding of the medium support part. This is because the first wall on one side and the second wall on the other side do not interfere with respect to each other during sliding of the medium support part. As such, the above-described aspect makes it possible to provide a recording apparatus with which cutting and the like of a recording medium during sliding of a medium support part can be prevented, and with which the medium support part can be reduced in size in a sliding direction.

Herein, the above-described recording apparatus encompasses inkjet printers, wire dot printers, laser printers, line printers, copy machines, facsimiles, and the like.

The first wall on one side and the second wall on the other side can take an arrangement that does have interference during non-sliding of the medium support part, provided that there is no interference during sliding of the medium support part.

The first wall on one side and the second wall on the other side can be arranged not to overlap as viewed in the sliding direction during sliding of the medium support part. As such, this aspect makes it possible to provide a recording apparatus with which cutting and the like of a recording medium during sliding of a medium support part can be prevented.

Here, for the first wall on one side and the second wall on the other slide not to overlap as viewed in the sliding direction also means that the first wall on one side and the second wall on the other side do not overlap as viewed in a side view from a direction substantially orthogonal to the conveyance direction of the recording medium and the sliding direction of the medium support part.

The wall (e.g., the first wall on one side) of the first medium path on one side in the sliding direction and a wall (hereinafter a "second wall on one side") of the second medium path on one side in the sliding direction can overlap in a side view so as not to interfere with respect to each other during sliding of the medium support part. This aspect makes it possible to prevent catching of a leading end of the recording medium on a boundary on one side of the sliding direction between the first medium path and the second medium path when the leading end of the recording medium is being conveyed.

The first wall on one side and the second wall on one side can have comb tooth shapes, respectively, that are arranged relative to each other without interference during sliding of the medium support part. This aspect makes it possible to provide a suitable example for preventing catching of the leading end of the recording medium on the boundary on the one side in the sliding direction between the first medium path and the second medium path.

A portion of the second wall on one side can be disposed on the other side in the sliding direction with respect to a portion of the first wall on one side while the medium support part is located at a stowed position. The recording medium is configured to pass through the first and second medium paths while the medium support part is located at the stowed position. The portions of the walls of the first and second medium paths are configured to overlap with respect to each other in a side view. This aspect makes it possible to provide a suitable example for preventing catching of the leading end of the recording medium on the boundary on one side in the sliding direction between the first medium path and the second medium path when the recording medium is being conveyed from the second medium path to the first medium path.

A wall (hereinafter a "first wall on the other side") of the first medium path on the other side in the sliding direction and the wall (e.g., the second wall on the other side) of the second medium path on the other side in the sliding direction can be arranged to overlap with respect to each other as viewed in the sliding direction such that the first wall on the other side and the second wall on the other side do not contact with respect to each other. This aspect makes it possible to prevent breakage of the walls of the medium paths, because the second wall on the other side does not collide with the first wall on the other side during sliding of the medium support part.

On the first medium path, a distance between the first wall on one side and the first wall on the other side in the sliding direction can increase as moving towards the opening of the first medium path. This aspect makes it possible for the leading end of a variety of recording media to be conveyed in an unencumbered manner when the recording media are being conveyed from the second medium path to the first medium path.

BRIEF DESCRIPTION OF THE DRAWINGS

Referring now to the attached drawings which form a part of this original disclosure.

DETAILED DESCRIPTION OF EMBODIMENTS

A selected embodiment will now be explained with reference to the drawings. It will be apparent to those skilled in the art from this disclosure that the following description of the embodiment is provided for illustration only and not for the purpose of limiting the invention as defined by the appended claims and their equivalents. Also, not all of the features illustrated in the embodiment are necessarily essential for the means of solving of the present disclosure.

Figure 1:
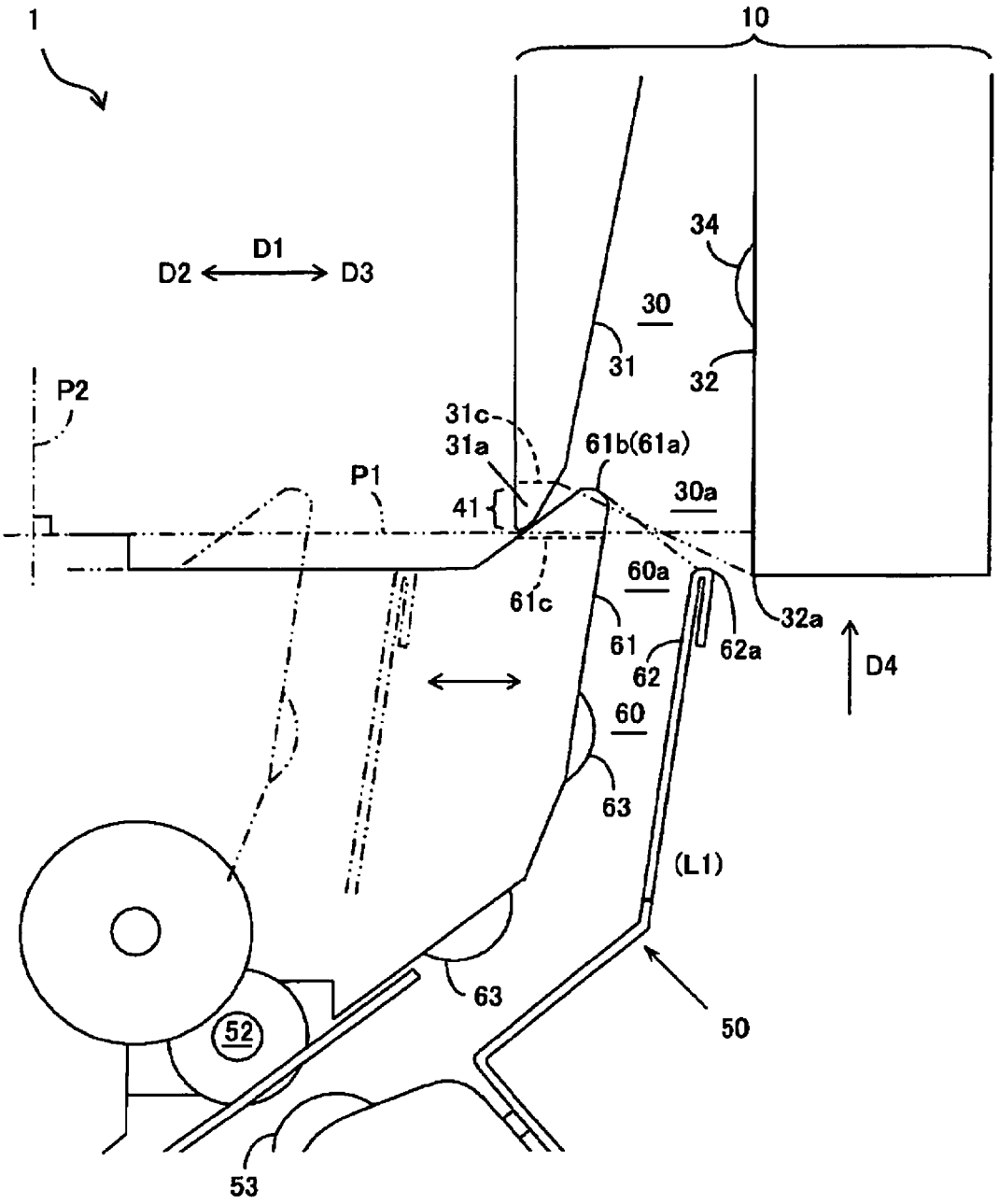
FIG. 1 is a partial side view of a recording apparatus 1, illustrating main parts of the recording apparatus 1.
Figure 2:
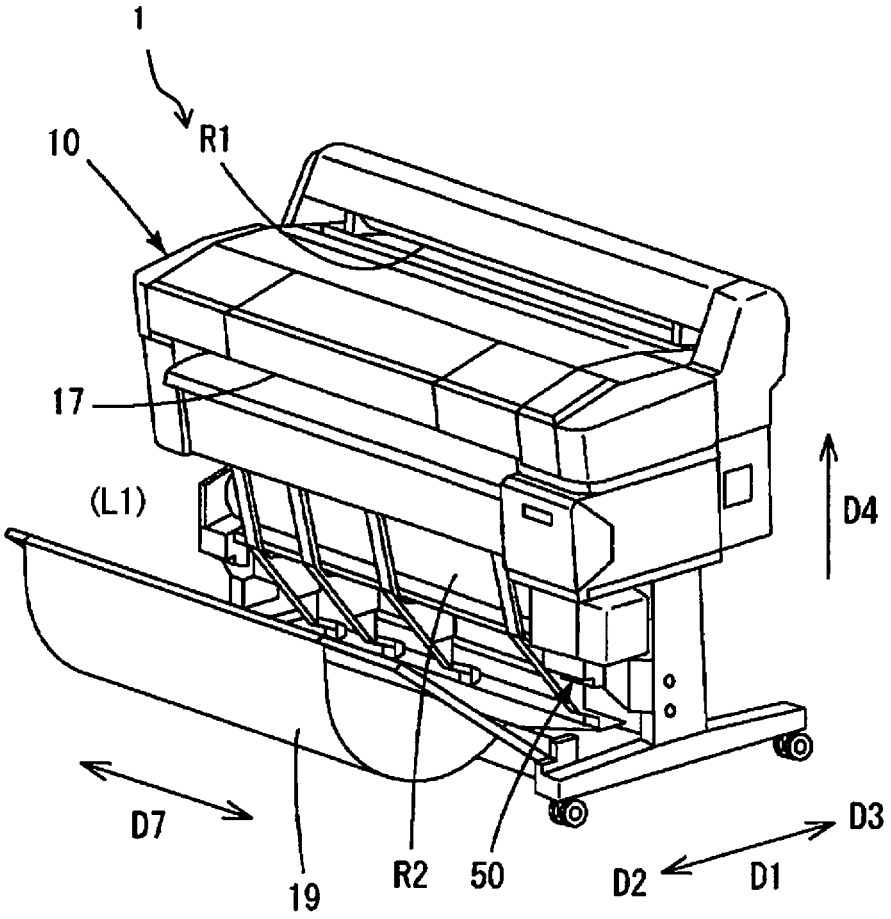
FIG. 2 is a perspective view of the recording apparatus 1, illustrating an outer appearance of the recording apparatus 1.
Figure 3:
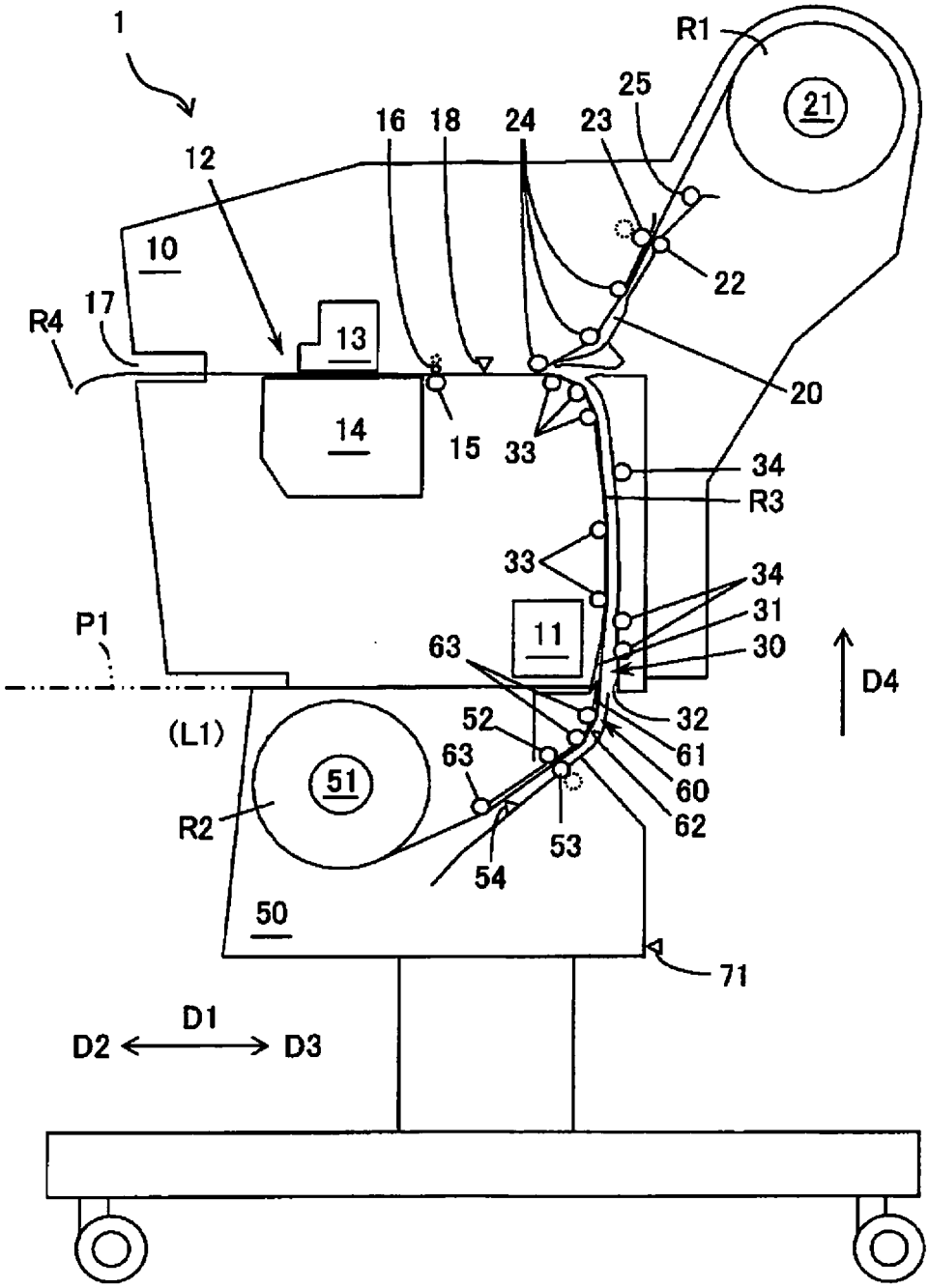
FIG. 3 is a longitudinal cross sectional view of the recording apparatus 1, illustrating a state where a paper feed unit 50 has been stowed.
Figure 4:
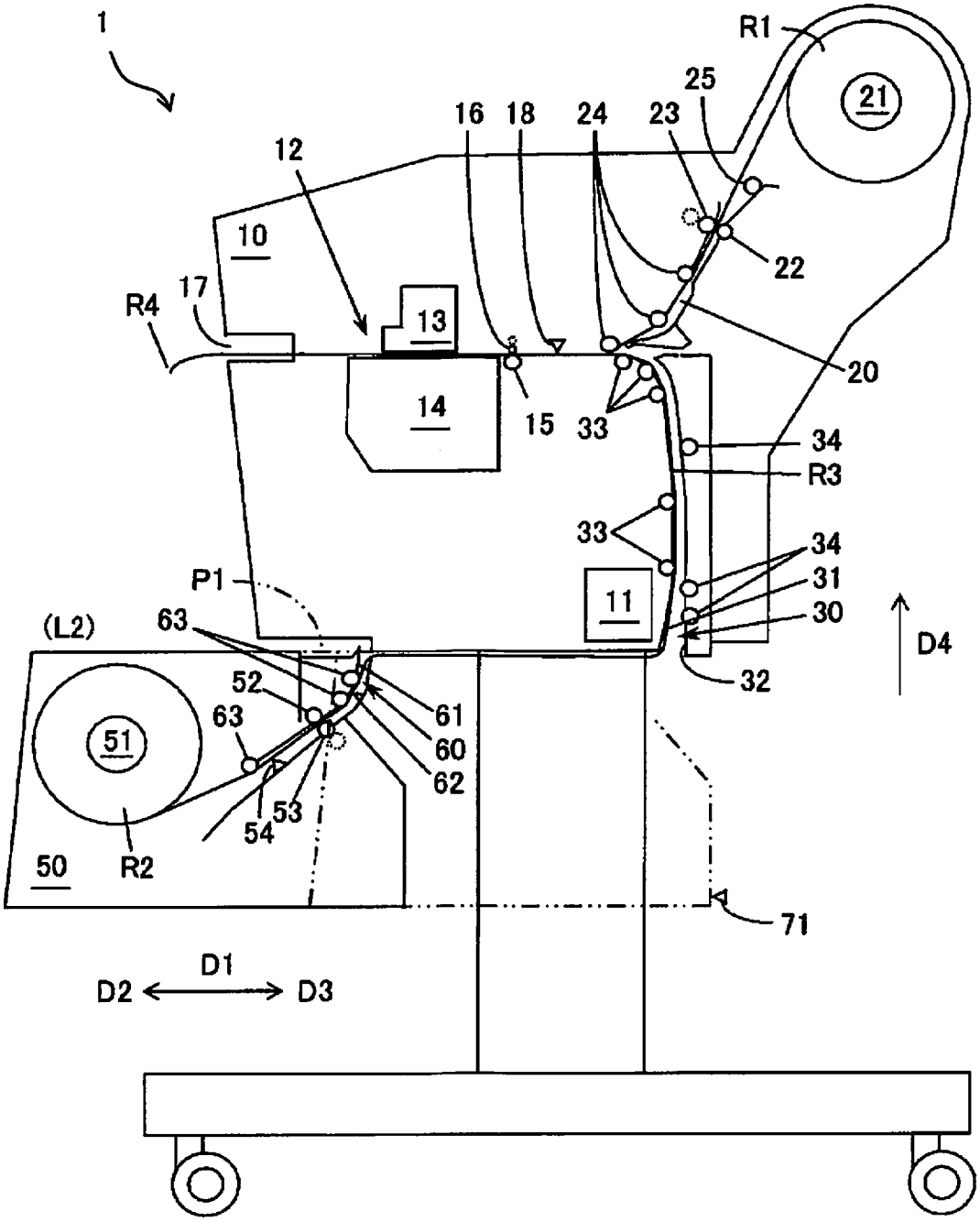
FIG. 4 is a longitudinal cross sectional view of the recording apparatus 1, illustrating a state where the paper feed unit 50 has been pulled out.
Figure 5:
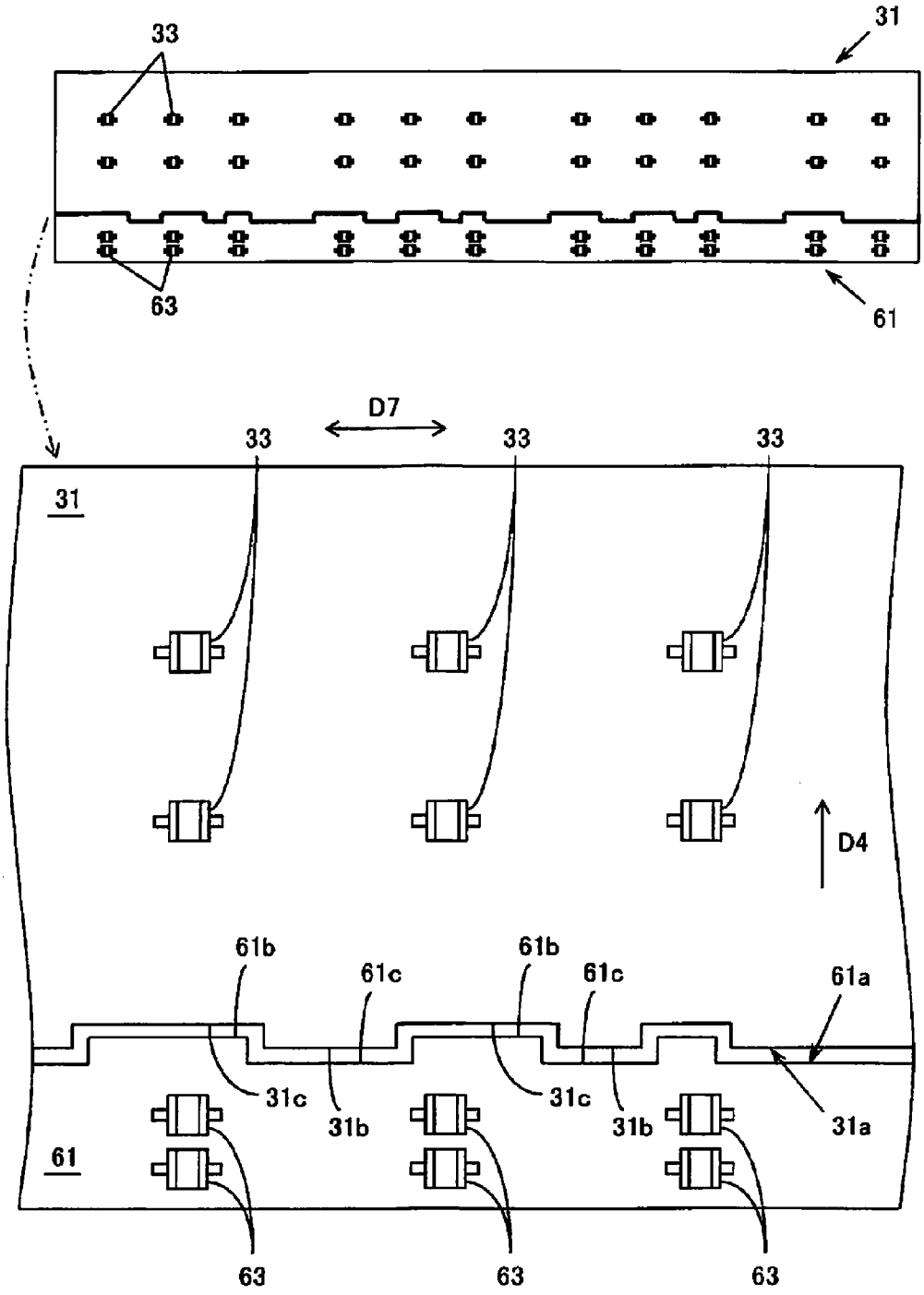
FIG. 5 is a partial rear elevational view of the recording apparatus 1, illustrating walls on one side 31 and 61 of medium paths of the recording apparatus 1.

FIG. 1 is a partial side view of a recording apparatus 1, illustrating main parts of the recording apparatus 1. FIG. 2 is a perspective view of the recording apparatus 1, illustrating an outer appearance of a large-scale inkjet printer serving as the recording apparatus 1. FIGS. 3 and 4 are longitudinal cross sectional views of the recording apparatus 1, illustrating the recording apparatus 1 except for a stacker 19. In particular, FIG. 3 illustrates a state where a paper feed unit (e.g., a medium support part) 50 is at a predetermined stowed position L1. FIG. 4 illustrates a state where the paper feed unit 50 is at a predetermined pulled-out position L2. The stowed position L1 is a position at which a sheet (e.g., a recording medium) R3 passes through medium paths (e.g., first and second medium paths 30 and 60). FIG. 5 is a partial rear elevational view of the recording apparatus 1, illustrating walls on one side 31 and 61 of the medium paths (e.g., the first and second medium paths 30 and 60).

In the drawings described above, the reference numeral D1 illustrates a sliding direction of the paper feed unit 50 in relation to a housing 10. The reference numeral D2 illustrates a pulling-out direction going towards the pulled-out position L2 from the stowed position L1. In other words, the reference numeral D2 illustrates one side in the sliding direction D1, to which side the connection of the second medium path 60 of the paper feed unit 50 is separated from the first medium path 30 of the housing 10. The reference numeral D3 illustrates a stowing direction going towards the stowed position L1 from the pulled-out position L2. In other words, the reference numeral D3 illustrates the other side in the sliding direction D1, to which side the separated second medium path 60 is connected to the first medium path 30. The reference numeral D4 illustrates a conveyance direction of the sheet (e.g., the recording medium) R3 crossing over the sliding direction D1. The reference numeral D7 illustrates a recording apparatus width direction, which is orthogonal to the sliding direction D1 and the conveyance direction D4. FIGS. 1, 3, and 4 are drawings in which the recording apparatus 1 is illustrated in the side view from the outside of the width direction D7. The reference numeral P1 illustrates a sliding plane defined between the housing 10 and the paper feed unit 50. The sliding plane P1 that is illustrated is a plane parallel to the sliding direction D1, and is a plane that intersects with parts of the housing 10 and paper feed unit 50. For example, the sliding plane P1 intersects with a distal end of the first wall on one side 31 as shown in FIG. 1. The reference numeral P2 illustrates a projection plane orthogonal to the sliding direction D1. A shape of the walls on one side 31 and 61 projected onto the projection plane P2 is the shape illustrated in FIG. 5.

The drawings are in some instances not consistent with one another, for the sake of ease of understanding.

Moreover, the positional relationships described in the present disclosure are merely illustrative examples for describing the invention, and are not for limiting the invention. As such, the invention also encompasses arrangements of the paper supply unit at positions other than below the housing, e.g., above, to the left, or to the right.

The recording apparatus 1 includes the housing 10 and the paper feed unit 50. The paper feed unit 50 is slidable with respect to the housing 10. The paper feed unit 50 is able to print or record by switching between a first roll of paper R1 at the back of the upper part of the apparatus and a second roll of paper R2 at a lower part of the apparatus. The rolls of paper are continuous paper obtained when a sheet is wound into a roll. The outsides of both rolls of paper R1 and R2 serve as print surfaces. It will be readily understood that when the positions of feed-out mechanisms 21 and 51 are changed, it would also be possible to use rolls of paper with which the insides serve as print surfaces. For the rolls of paper, it would be possible to use wound sheets of a variety of materials, such as paper, cloth, plastic sheet, or leather.

As illustrated in FIG. 3 and elsewhere, the housing 10 includes, among other things, a control unit 11, a recording unit 12, a conveyor roller pair (15 and 16), a discharge unit 17, a cutter 18, a stacker 19, a medium path 20 and paper feed mechanism (21 to 25) for the first roll of paper, and a first medium path 30 and rolling rollers (e.g., driven rollers) (33 and 34) for the second roll of paper.

The control unit 11 has a central processing unit (CPU), a read-only memory (ROM), a random access memory (RAM), and so forth. The control unit 11 controls the operation of each of the parts of the recording apparatus 1, such as by accepting a command for recording output from an external host apparatus and printing onto the sheet-shaped recording medium. The recording medium intended for printing is a portion that has been pulled out from either of the first and second rolls of paper R1 and R2 and, in the case of the second roll of paper R2, would be a continuous sheet R3.

The recording unit 12 has a recording head 13 and a platen 14. The recording head 13 is arranged on an upper side facing the platen 14, and is able to record by discharging an ink onto the recording medium. The platen 14 supports the recording medium, and gives a predetermined distance between the recording medium and the recording head 13.

The conveyor roller pair (15 and 16) includes a drive roller 15 arranged on a lower side and a driven roller 16 arranged on an upper side. The driven roller 16 is separable from the drive roller 15, and when nearby nips the recording medium along with the drive roller 15.

The recording medium sent out from the discharge unit 17 is cut by the cutter 18 and, when released from the nipping of the conveyor roller pair (15 and 16), is stacked on the stacker 19.

The paper supply mechanism for the first roll of paper includes, among other things, a feed-out mechanism 21 for supporting the first roll of paper R1, a paper feed roller pair (22 and 23), and rolling rollers (e.g., driven rollers) (24 and 25).

The paper feed roller pair (22 and 23) includes a drive roller 22 arranged on the stowing direction D3 side and a driven roller 23 arranged on the pulling-out direction D2 side. The driven roller 23 is separable from the drive roller 22, and when nearby nips the recording medium along with the drive roller 22. The rolling roller 24 is at a wall on the pulling-out direction D2 side of the medium path 20, and comes slightly out into the medium path 20 from an inner surface of this wall. The rolling roller 25 is at a wall on the stowing direction D3 side of the medium path 20, and comes slightly out into the medium path 20 from an inner surface of this wall.

During the supply of a fresh first roll of paper R1 that has been mounted onto the feed-out mechanism 21, a user would first place the leading end of the first roll of paper R1 between the paper feed roller pair (22 and 23). Thereafter, the feed-out mechanism 21 feeds out the first roll of paper R1, the sheet that is fed out is nipped by the paper feed roller pair (22 and 23) and conveyed toward the conveyor roller pair (15 and 16), and the conveyor roller pair (15 and 16) nip the sheet. During printing, the conveyor roller pair (15 and 16) conveys the sheet over the platen 14, and the recording head 13 discharges ink to record onto the sheet.

The first medium path 30, through which the sheet R3 that is conveyed to the recording unit 12 is passed, has a first wall on one side 31 on the pulling-out direction D2 side and a first wall on the other side 32 on the stowing direction D3 side. The first wall on one side 31 serves as an inside portion of the first medium path 30 that is bent toward the recording unit 12. The rolling rollers (e.g., the driven rollers) 33 are provided to the first wall on one side 31. As illustrated in FIG. 5, there are pluralities of the rolling rollers 33. The rolling rollers 33 are arranged in the conveyance direction D4 and the width direction D7 each, and come slightly out into the first medium path 30 from the inner surface of the first wall on one side 31. The first wall on the other side 32 serves as an outside portion of the first medium path 30. The rolling rollers (e.g., the driven rollers) 34 coming slightly out into the first medium path 30 from the inner surface are provided to the first wall on the other side 32.

The paper feed unit (e.g., the medium support part) 50 includes, among other things, the feed-out mechanism 51 for supporting the second roll of paper R2, a paper feed roller pair (52 and 53), a medium detection sensor 54, and rolling rollers (e.g., driven rollers) 63 that are at a wall on the pulling-out direction D2 side of the second medium path 60. The paper feed unit 50 is slidable between the stowed position L1 and the pulled-out position L2, and is electrically connected to the control unit 11.

The paper feed roller pair (52 and 53) includes a drive roller 52 arranged on the pulling-out direction D2 side and a driven roller 53 arranged on the stowing direction D3 side. The driven roller 53 is separable from the drive roller 52, and when nearby nips the sheet R3 together with the drive roller 52.

The medium detection sensor 54 detects whether or not the sheet R3 is being supplied in front of the paper feed roller pair (52 and 53) on the second medium path 60.

The second medium path 60 through which the sheet R3 that is conveyed on the first medium path 30 passes has a second wall on one side 61 on the pulling-out direction D2 side and a second wall on the other side 62 on the stowing direction D3 side. The second wall on one side 61 serves as an inside portion of the second medium path 60 that is bent from the feed-out mechanism 51. The rolling rollers 63 are provided to the second wall on one side 61. As illustrated in FIG. 5, there are pluralities of the rolling rollers 63 that are arranged in the conveyance direction D4 and the width direction D7 each. The rolling rollers 63 come slightly out into the second medium path 60 from the inner surface of the second wall on one side 61.

Figure 7:
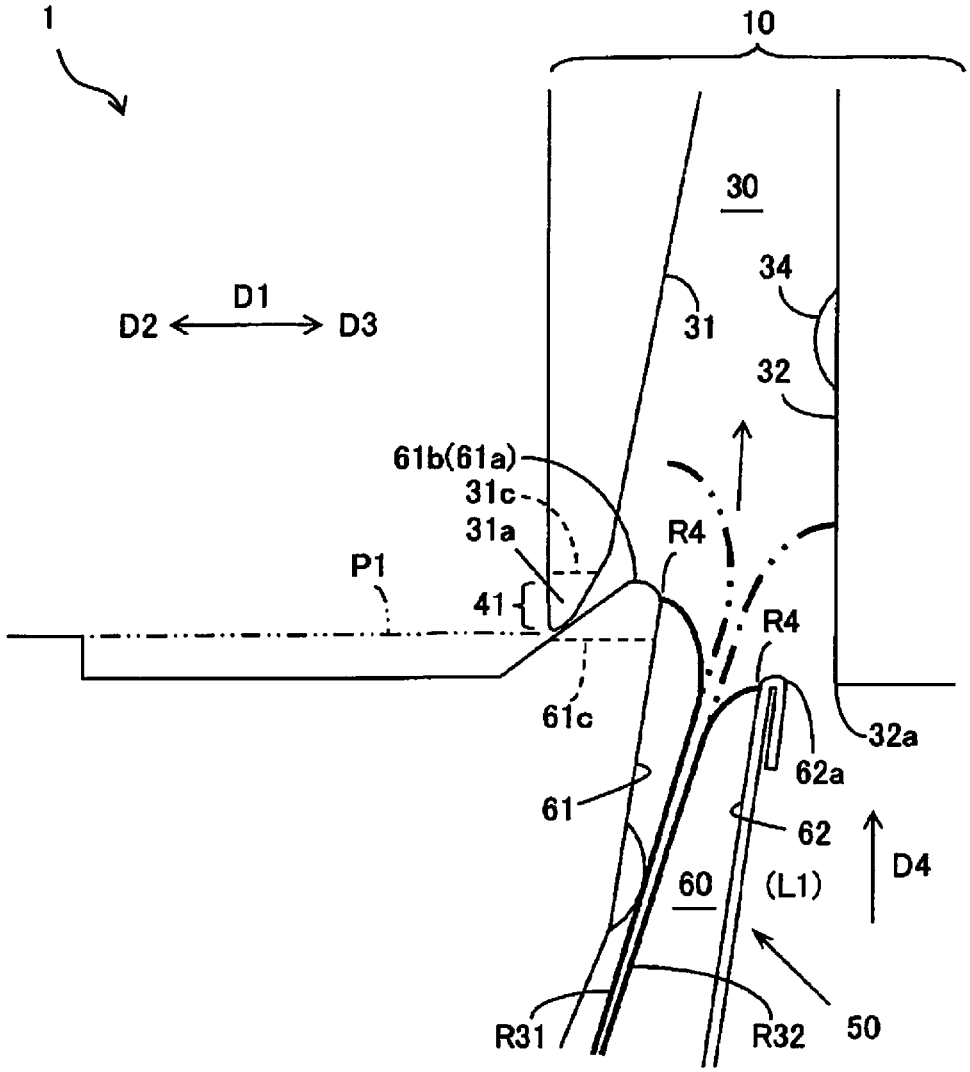
FIG. 7 is a partial side view of the recording apparatus 1, illustrating an operation of the recording apparatus 1.

During the supply of a fresh second roll of paper R2 that has been mounted onto the feed-out mechanism 51, a user would first place the leading end R4 of the second roll of paper R2 between the paper feed roller pair (52 and 53). Thereafter, the feed-out mechanism 51 feeds out the second roll of paper R2, and the sheet R3 that is fed out is nipped by the paper feed roller pair (52 and 53) inside the second medium path and conveyed towards the first medium path 30. At this time, depending on the peculiar curl of the second roll of paper R2, there are instances where the leading end R4 is bent and contacts the walls on one side 31 and 61, as with the sheet R31 in FIG. 7, and there are instances where the leading end R4 is bent and contacts the walls on the other side 32 and 62, as with the sheet R32 in FIG. 7. The sheet R3 that has passed through the first medium path 30 and been conveyed between the conveyor roller pair (15 and 16) is nipped by the conveyor roller pair (15 and 16). Thereafter, the paper feed roller pair (52 and 53) can release the sheet R3 from the nip. During printing or recording, the sheet R3 that is on the upstream side of the medium path is held at the feed-out mechanism 51, while the sheet R3 that is on the downstream side of the medium path is held at the conveyor roller pair (15 and 16). During this printing, the conveyor roller pair (15 and 16) conveys the sheet R3 over the platen 14, and the recording head 13 discharges ink and records onto the sheet R3. The series of operations is controlled by the control unit 11.

The recording apparatus 1 also includes a position detection sensor 71 for determining whether or not the paper feed unit 50 is at the stowed position L1. When the paper feed unit 50 is not detected as being at the stowed position L1, or when the sheet R3 is not detected by the medium detection sensor 54, then the control unit 11 does not perform the above-described series of operations.

The drive rollers and driven rollers forming the roller pairs can have the reverse arrangements of the positional relationships described above. Also, using a drive roller instead of a driven roller, the roller pairs can include a pair of drive rollers.

Now, as with the image formation apparatus disclosed in Japanese Unexamined Patent Application Publication No. 2003-12205, when the orientation of a guide plate is inclined closer to the horizontal direction than to the vertical direction, then gravity causes the leading end of the sheet being guided to contact a lower-side (or outside) guide plate. That is to say, the sheet leading end does not contact an upper-side (or inside) guide plate. Therefore, there is no need to provide for overlapping of the upper-side (or inside) guide plate in order to prevent the sheet leading end for catching onto the portion of contact of the medium path. The position of the edge of the outside guide plate, which is at a lower-side paper feed unit, will be up when the orientation of the guide plate is brought closer to the vertical direction. For this reason, pulling out the paper feed unit results in interference between the outside guide plate that is at the lower-side paper feed unit and the inside guide plate that is in an upper-side apparatus body.

With the recording apparatus 1, the connecting portion of the medium paths takes an orientation close to vertical (i.e., an orientation closer to the vertical direction than to the horizontal direction), while at the same time the position of an edge 62*a* of the second wall on the other side 62, which would be the stowing direction D3 side, is brought down. Therefore, there is no interference between the first wall on one side 31 and the second wall on the other side 62 during sliding of the paper feed unit. On the other hand, it is necessary to have enough overlapping of the walls on one side 31 and 61, which would be the pulling-out direction D2 side, in order to prevent catching of the sheet leading end.

In view of the state of the background, the two medium paths 30 and 60 are formed as described below.

As illustrated in FIG. 1 and elsewhere, the second medium path 60 of the paper feed unit 50 at the stowed position L1 is connected to the first medium path 30. The two medium paths 30 and 60 will be described in detail below.

The first wall on one side 31, which would be the pulling-out direction D2 side of the first medium path 30, is inclined towards the pulling-out direction D2 side as moving closer to an opening 30*a* end in the vicinity of the opening 30*a*. The opening 30*a* is connected to the second medium path 60. As illustrated in FIG. 5 and elsewhere, an edge 31*a* of the first wall on one side 31 that defines the opening 30*a* of the first medium path 30 is formed so as to have a comb tooth shape where rectangular convexities 31*b* and concavities 31*c* are alternately repeated.

An edge 32*a* of the first wall on the other side 32 also defines the opening 30*a* of the first medium path 30. The edge 32*a* of the first wall on the other side 32, which is the stowing direction D3 side of the first medium path 30, is lower than the sliding plane P1, and also lower than the edge 31*a* of the first wall on one side 31. In the vicinity of the opening 30*a* of the first medium path 30, the first wall on one side 31 and the first wall on the other side 32 spread in the sliding direction D1 as moving towards the opening 30*a* of the first medium path 30.

The second wall on one side 61, which is the pulling-out direction D2 side of the second medium path 60, is inclined towards the stowing direction D3 side as moving closer to an opening 60*a* end in the vicinity of the opening 60*a*. The opening 60*a* is connected to the first medium path 30. As illustrated in FIG. 5 and elsewhere, an edge 61*a* of the second wall on one side 61 that defines the opening 60*a* of the second medium path 60 is formed so as to have a comb tooth shape where rectangular convexities 61*b* and concavities 61*c* are alternately repeated. More specifically, as seen from the pulling-out direction D2 or the stowing direction D3, the convexities 61*b* of the second wall on one side 61 are set at intervals in the concavities 31*c* of the first wall on one side 31, while the convexities 31*b* of the first wall on one side 31 are set at intervals in the concavities 61*c* of the second wall on one side 61. As illustrated in FIG. 1, the convexities 61*b* of the second wall on one side are above the sliding plane P1 and also above the convexities 31*b* of the first wall on one side. The walls on one side 31 and 61 have a portion 41 of overlap in the sliding direction D1. As such, the walls on one side 31 and 61 overlap in the sliding direction D1 in the side view, but are formed in the comb tooth shapes so as not to interfere with one another during sliding of the paper feed unit 50.

Here, for the walls on one side 31 and 61 not to interfere with one another during sliding of the paper feed unit 50 also means that when the walls on one side 31 and 61 are projected onto the projection plane P2 orthogonal to the sliding direction D1, then the portions of projection of the walls on one side 31 and 61 do not overlap. Further, the side view means viewing from a direction substantially orthogonal to the sliding direction D1 and the conveyance direction D4, in the width direction D7. Furthermore, for the walls on one side 31 and 61 to overlap in the sliding direction D1 in the side view also means that the walls on one side 31 and 61 overlap with one another as seen from a direction substantially orthogonal to the directions D1 and D4.

Also, the second wall on one side 61 is disposed on the stowing direction D3 side in a stepwise manner with respect to the first wall on one side at the portion 41 of overlap in the sliding direction D1 in the side view when the paper feed unit 50 is at the stowed position L1.

The second wall on the other side 62, which is on the stowing direction D3 side of the second medium path 60, is inclined towards the stowing direction D3 side as moving closer to the opening 60*a* end in the vicinity of the opening 60*a*. The opening 60*a* is connected to the first medium path 30. The edge 62*a* of the second wall on the other side 62 defines the opening 60*a* of the second medium path 60. The edge 62*a* of the second wall on the other side 62 is above the edge 32*a* of the first wall on the other side 32 and below the sliding plane P1, and also below the convexities 31*b* of the first wall on one side. As such, the first wall on one side 31 and the second wall on the other side 62 do not interfere with one another, being without overlap in the sliding direction D1 in the side view during sliding of the paper feed unit 50. It will be readily understood that for the first wall on one side 31 and the second wall on the other side 62 not to overlap with one another in the sliding direction D1 in the side view also means that the first wall on one side 31 and the second wall on the other side 62 do not overlap with one another as seen from a direction substantially orthogonal to the directions D1 and D4. Also, this means that the first wall on one side 31 and the second wall on the other side 62 do not overlap with one another as viewed in the sliding direction D1.

The openings 30*a* and 60*a* of the medium paths are both formed in the sliding plane P1. The openings of the medium paths could be said to be on the sliding plane in a case where, for example, the sliding plane P1 is crossed by line segments connecting the edges that define the openings of the walls on one side and the edges that define the openings of the walls on the other side in the side view. In a case where there are concavities and convexities at the edges, then a line segment connecting to any of the concavities or convexities should cross the sliding plane P1. Also, in this case, the openings 30*a* and 60*a* are at least partially disposed on the sliding plane P1.

As illustrated in FIG. 1, the opening 30*a* is on the sliding plane P1 on the first medium path 30, because the concavities 31*c* of the wall on one side 31 are above the sliding plane P1 and the edge 32*a* of the wall on the other side 32 is below the sliding plane P1. On the second medium path 60, the opening 60*a* is on the sliding plane P1, because the convexities 61*b* of the second wall on one side 61 are above the sliding plane P1 and the edge 62*a* of the second wall on the other side 62 is below the sliding plane P1.

When the paper feed unit 50 is at the stowed position L1, the edge 62*a* of the second wall on the other side 62 takes a position separated in the pulling-out direction D2 side with respect to the edge 32*a* of the first wall on the other side 32. As such, the first wall on the other side 32 and the second wall on the other side 62 overlap as viewed in the sliding direction D1 but do not contact each other.

The operation and effects of the recording apparatus 1 will be described next.

Figure 6:
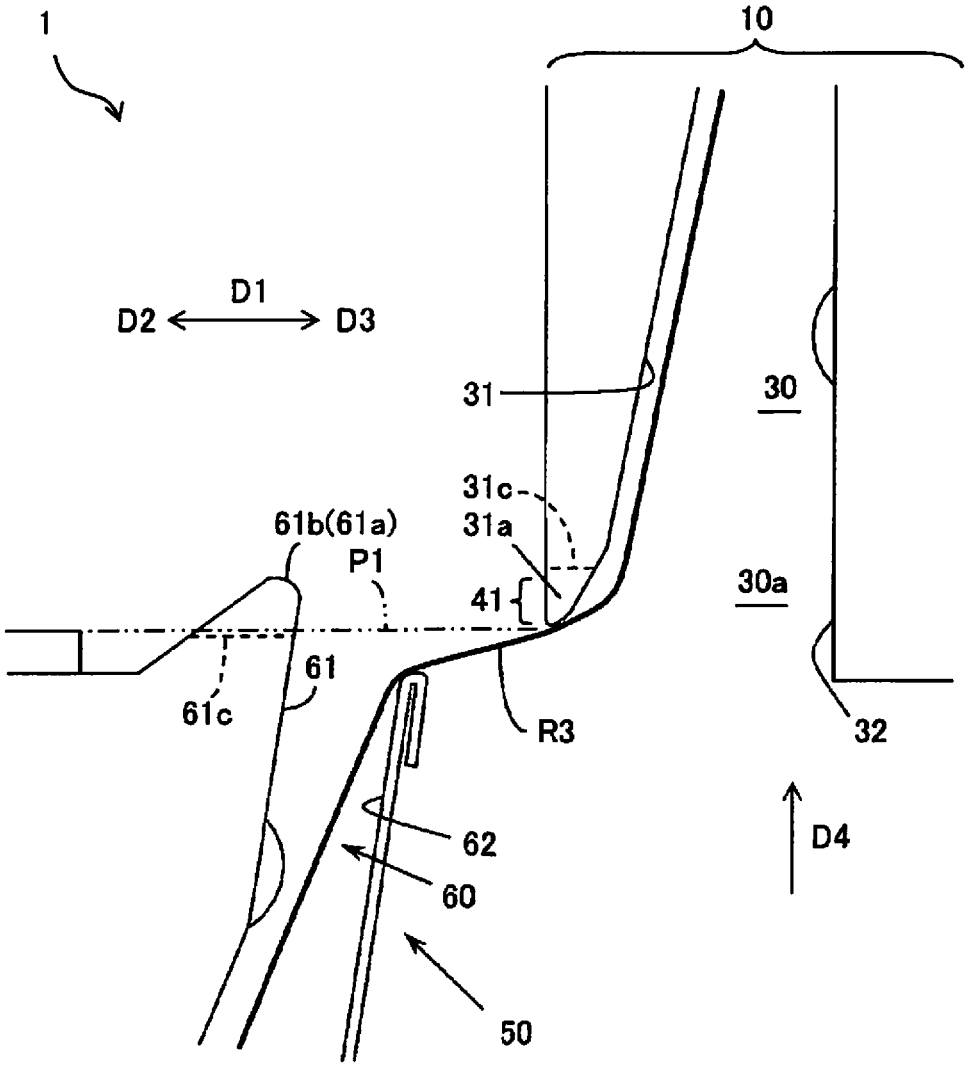
FIG. 6 is a partial side view of the recording apparatus 1, illustrating an operation of the recording apparatus 1.

As illustrated in FIG. 1, the openings 30*a* and 60*a* of the two medium paths 30 and 60 are formed on the sliding plane P1. Therefore, the first and second medium paths 30 and 60 do not protrude out to the apparatus back surface side, nor do the first and second medium paths 30 and 60 increase the size of the apparatus. Also, as illustrated in FIG. 6, the first wall on one side 31 and the second wall on the other side 62 do not interfere with one another, and do not overlap in the sliding direction D1 in the side view (or as viewed in the sliding direction D1) during sliding of the paper feed unit. Therefore, cutting, breaking, or the like of the sheet R3 by the walls 31 and 62 is prevented when the paper feed unit 50 is pulled out to the pulling-out direction D2 from the stowed position L1. As such, with the recording apparatus 1, cutting or the like of the sheet R3 during sliding of the paper feed unit 50 can be prevented, and the size of the paper feed unit 50 in the sliding direction D1 can be reduced.

Moreover, as illustrated in FIG. 1, the walls on one side 31 and 61 are overlapped in the sliding direction D1 in the side view so as not to interfere with one another during sliding of the paper feed unit. Therefore, catching of the leading end R4 on a boundary (or the portion 41) of the walls on one side 31 and 61 is prevented when the leading end R4 of the sheet R3 is being conveyed to the recording unit 12. When the leading end R4 bends to the pulling-out direction D2 side, as with, for example, the sheet R31 illustrated in FIG. 7, then in some instances the boundary (or the portion 41) of the walls on one side 31 and 61 can be contacted. However, catching of the leading end R4 is prevented because the boundary has no gap in the conveyance direction D4. In particular, the leading end R4 is less likely to catch because the walls on one side 31 and 61 are formed in comb tooth shapes that do not interfere with one another during sliding of the paper feed unit.

Moreover, when the paper feed unit 50 is at the stowed position L1, then the second wall on one side 61 is disposed on the stowing direction D3 side with respect to the first wall on one side 31 at the portion 41 of overlap in the sliding direction D1 in the side view. Therefore, the leading end R4 is less likely to catch at this point as well.

Also, as illustrated in FIG. 1, the first wall on the other side 32 and the second wall on the other side 62 overlap as viewed in the sliding direction D1, and do not contact each other. Therefore, the second wall on the other side 62 does not collide with the first wall on the other side 32 during sliding of the paper feed unit 50. As such, with the recording apparatus 1, breakage of the walls on the other side 32 and 62 of the two medium paths 30 and 60 can be prevented. When the leading end R4 bends to the stowing direction D3 side, as with the sheet R32 illustrated in FIG. 7, then in some instances the leading end R4 could contact the boundary of the walls on the other side 32 and 62 when the leading end R4 of the sheet R32 is being conveyed to the recording unit 12. Even in such a case, the leading end R4 is less likely to catch, because the second wall on the other side 62 is disposed on the pulling-out direction D2 side with respect to the first wall on the other side 32.

Furthermore, as illustrated in FIG. 1, the walls 31 and 32 of the first medium path 30 broaden in the sliding direction D1 as moving toward the opening 30*a* in the vicinity of the opening 30*a*. Therefore, the leading end R4 is conveyed in an unencumbered manner even though the leading end R4 can bent as with the sheets R31 and R32 illustrated in FIG. 7.

With the present disclosure, a variety of modification examples are conceivable.

For example, other than the rolls of paper, the recording media can be a folded-over continuous paper, cut paper, or the like.

Other than an apparatus for switching between a plurality of recording media to carry out recording, the recording apparatus can also be an apparatus for recording onto a single recording medium.

The medium support part can also be a paper feed unit that supports the first roll of paper R1 at the back of the upper part of the apparatus. Other than the paper feed unit, the medium support part can also be at a relay site where the recording medium that, though not yet recorded on, has been conveyed from the paper feed unit is supported and transferred to the housing, a discharge site where the now-recorded-on recording medium conveyed from the recording unit is supported, or the like.

The comb tooth shapes of the walls on one side 31 and 61 can be a shape where semi-elliptical convexities and concavities are alternately repeated, or the like.

The first wall on one side and the second wall on the other side can take an arrangement that does have interference during non-sliding of the medium support part if there is no interference during sliding of the medium support part. In a case where, for example, the second wall on the other side 62 has a mechanism for retracting downward, then the second wall on the other side 62 can be upwardly advanced out so as to overlap with the first wall on one side 31 when the leading end of the recording medium is being passed through the medium paths 60 and 30. When the medium support part is being pulled out, the second wall on the other side 62 can be retracted downward so as not to overlap with the first wall on one side 31. On the other hand, in a case where, for example, the first wall on one side 31 has a mechanism for retracting upward, then the first wall on one side 31 can be downwardly advanced out so as to overlap with the second wall on the other side 62 when the leading end of the recording medium is being passed through the medium paths 60 and 30. When the medium support part is being pulled out, the first wall on one side 31 can be upwardly retracted so as not to overlap with the second wall on the other side 62.

Also, the first wall on one side and the second wall on the other side can overlap in the sliding direction in the side view (or as viewed in the sliding direction) as long as there is no interference during sliding of the medium support part. For example, the effect of preventing cutting and the like of the recording medium is still obtained even when the first wall on one side and the second wall on the other side are formed in shape of concavities and convexities that do not have interference during sliding of the medium support part.

As has been described above, the variety of aspects make it possible to prevent cutting and the like of the recording medium during sliding of the medium support part, and make it possible to provide a technology and the like with which the medium support part can be reduced in size in the sliding direction. It will be readily understood that the fundamental actions and effects described above are also obtained with the configuration as described in independent claim that does not include the configurations as described in dependent claims.

It would also be possible to implement, among other things, a configuration obtained by combining or substituting with one another each of the configurations disclosed in the above-described embodiment and modification examples, or a configuration obtained by substituting known features and each of the configurations disclosed in the above-described embodiment and modification examples with one another or by modifying combinations thereof. The present invention also encompasses these configurations and the like.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A recording apparatus comprising:

a housing with a recording unit that is configured to record onto a recording medium, the housing having a pair of first walls that define a first medium path therebetween, with the recording medium being configured to pass through the first medium path; and a medium support part slidable with respect to the housing in a sliding direction between a stowed position and a pulled-out position, the pulled-out position being located on one side in the sliding direction with respect to the stowed position, the medium support part having a pair of second walls that define a second medium path therebetween, with the recording medium being configured to pass through the second medium path, with the second medium path being configured to connect with the first medium path, one of the first walls being disposed on the one side in the sliding direction relative to the other one of the first walls, one of the second walls being disposed on the one side in the sliding direction relative to the other one of the second walls, the first and second medium paths having openings that are at least partially disposed on a sliding plane defined between the housing and the medium support part, the one of the first walls and the other one of the second walls being arranged not to contact with respect to each other while the medium support part slides towards the one side in the sliding direction from the stowed position to the pulled-out position, the first and second medium paths being arranged such that an imaginary line extending parallel to the sliding direction through a distal end of the one of the first walls intersecting with the opening of the second medium path, distal ends of the second walls are both disposed between the distal end of the one of the first walls and a distal end of the other one of the first walls in the sliding direction while the medium support part is located at the stowed position, and the distal ends of the second walls are both disposed on the one side in the sliding direction relative to the distal end of the one of the first walls while the medium support is located at the pulled-out position.

2. The recording apparatus according to claim 1, wherein the one of the first walls and the other one of the second walls are arranged not to overlap with respect to each other as viewed in the sliding direction while the medium support part slides in the sliding direction.

3. The recording apparatus according to claim 1, wherein the recording medium is configured to pass through the first and second medium paths while the medium support part is located at the stowed position, a portion of the one of the second walls is disposed on the other side in the sliding direction with respect to a portion of the one of the first walls while the medium support part is located at the stowed position, with the portion of the one of the first walls and the portion of the one of the second walls being configured to overlap with respect to each other in a side view.

4. The recording apparatus according to claim 1, wherein a distance between the one of the first walls and the other one of the first walls increases as moving towards the opening of the first medium path.

5. A recording apparatus comprising:

a housing with a recording unit that is configured to record onto a recording medium, the housing having a pair of first walls that define a first medium path therebetween, with the recording medium being configured to pass through the first medium path; and a medium support part slidable with respect to the housing in a sliding direction between a stowed position and a pulled-out position, the pulled-out position being located on one side in the sliding direction with respect to the stowed position, the medium support part having a pair of second walls that define a second medium path therebetween, with the recording medium being configured to pass through the second medium path, with the second medium path being configured to connect with the first medium path, one of the first walls being disposed on the one side in the sliding direction relative to the other one of the first walls, one of the second walls being disposed on the one side in the sliding direction relative to the other one of the second walls, the first and second medium paths having openings that are at least partially disposed on a sliding plane defined between the housing and the medium support part, the one of the first walls and the other one of the second walls being arranged not to contact with respect to each other while the medium support part slides towards the one side in the sliding direction from the stowed position to the pulled-out position, the one of the first walls and the one of the second walls being arranged to overlap with respect to each other in a side view such that the one of the first walls and the one of the second walls do not contact with respect to each other while the medium support part slides in the sliding direction, distal ends of the second walls are both disposed between a distal end of the one of the first walls and a distal end of the other one of the first walls in the sliding direction while the medium support part is located at the stowed position, and the distal ends of the second walls are both disposed on the one side in the sliding direction relative to the distal end of the one of the first walls while the medium support is located at the pulled-out position.

6. The recording apparatus according to claim 5, wherein the one of the first walls and the one of the second walls have comb tooth shapes, respectively, that are arranged not to contact with respect to each other while the medium support part slides in the sliding direction.

7. A recording apparatus comprising:

a housing with a recording unit that is configured to record onto a recording medium, the housing having a pair of first walls that define a first medium path therebetween, with the recording medium being configured to pass through the first medium path; and a medium support part slidable with respect to the housing in a sliding direction between a stowed position and a pulled-out position, the pulled-out position being located on one side in the sliding direction with respect to the stowed position, the medium support part having a pair of second walls that define a second medium path therebetween, with the recording medium being configured to pass through the second medium path, with the second medium path being configured to connect with the first medium path, one of the first walls being disposed on the one side in the sliding direction relative to the other one of the first walls, one of the second walls being disposed on the one side in the sliding direction relative to the other one of the second walls, the first and second medium paths having openings that are at least partially disposed on a sliding plane defined between the housing and the medium support part, the one of the first walls and the other one of the second walls being arranged not to contact with respect to each other while the medium support part slides towards the one side in the sliding direction from the stowed position to the pulled-out position, the other one of the first walls and the other one of the second walls being arranged to overlap with respect to each other as viewed in the sliding direction such that the other one of the first walls and the other one of the second walls do not contact with respect to each other, distal ends of the second walls are both disposed between a distal end of the one of the first walls and a distal end of the other one of the first walls in the sliding direction while the medium support part is located at the stowed position, and the distal ends of the second walls are both disposed on the one side in the sliding direction relative to the distal end of the one of the first walls while the medium support is located at the pulled-out position.

* * * * *